US008325967B2

(12) United States Patent
Tanabe

(10) Patent No.: US 8,325,967 B2
(45) Date of Patent: Dec. 4, 2012

(54) SPEAKER APPARATUS

(75) Inventor: Kei Tanabe, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 247 days.

(21) Appl. No.: 12/958,060

(22) Filed: Dec. 1, 2010

(65) Prior Publication Data

US 2011/0135140 A1 Jun. 9, 2011

(30) Foreign Application Priority Data

Dec. 7, 2009 (JP) ..... 2009-277629

(51) Int. Cl.
*H04R 25/00* (2006.01)

(52) U.S. Cl. ..... 381/403; 381/420

(58) Field of Classification Search ..... 381/400, 381/403, 404, 407, 412, 416, 419, 420, 432, 381/433

See application file for complete search history.

(56) References Cited

U.S. PATENT DOCUMENTS 4,737,992 A 4/1988 Latham-Brown et al.
5,040,221 A 8/1991 Edwards et al.
6,330,340 B1 * 12/2001 Proni ..... 381/397
6,836,551 B2 * 12/2004 Kuze et al. ..... 381/412
2004/0218778 A1 * 11/2004 Weisman ..... 381/396
2008/0199039 A1 * 8/2008 Bohlender et al. ..... 381/412

FOREIGN PATENT DOCUMENTS

JP 62-136196 6/1987

* cited by examiner

*Primary Examiner* — Fan Tsang
*Assistant Examiner* — Phylesha Dabney
(74) *Attorney, Agent, or Firm* — Brinks Hofer Gilson & Lione

(57) ABSTRACT

A light weight and low profile speaker apparatus is provided. In one embodiment, the speaker apparatus includes: a frame member; a magnetic circuit; a supporting member disposed on a bottom portion of the frame member for securing and supporting the magnetic circuit at an opposite circumferential end portion of a circumferential wall portion of a first yoke relative to a plate portion; a voice coil unit disposed inside a magnetic gap in the magnetic circuit; a coupling member disposed outward of the circumferential wall portion of the first yoke; and a diaphragm having an inner circumferential end portion coupled to the coupling member. The voice coil unit and the coupling member are joined by a joint member that extends in a direction transverse to the circumferential wall portion of the first yoke; and a space where the joint member joining the voice coil unit and the coupling member can move is formed in each of the circumferential wall portion of the first yoke and the supporting member.

17 Claims, 18 Drawing Sheets

SPEAKER APPARATUS

BACKGROUND OF THE INVENTION

1. Related Application

The present application claims priority to Japanese Patent Application Number 2009-277629, filed Dec. 7, 2009, the entirety of which is hereby incorporated by reference.

2. Field of the Invention

The present invention relates to a speaker apparatus that outputs sound through the vibration of a diaphragm coupled to a voice coil due to interaction between a magnetic field generated in a magnetic circuit and a sound signal electric current flowing through the voice coil.

3. Description of the Related Art

In the past, there have been proposed so-called counter drive type speaker apparatuses in which a magnetic circuit is disposed substantially in the center of a space surrounded by a cone shaped diaphragm (see Japanese Patent Application Publication No. 1987(S62)-136196, for example). In such a speaker apparatus, in addition to a frame (a basket shaped rear portion made of plastic) for housing components such as a diaphragm and a damper, another frame (a basket shaped front portion made of plastic) is disposed on the front part of the diaphragm, and the magnetic circuit is supported and secured by this front frame. A voice coil unit disposed inside a magnetic gap in the magnetic circuit is coupled to the inner circumferential edge of the diaphragm. In such a speaker apparatus, because the magnetic circuit is disposed inside the space surrounded by the cone shaped diaphragm, the space is efficiently used and thickness reduction can be achieved.

However, such a conventional speaker apparatus has a disadvantage of increased weight because, in addition to the frame for mounting and housing the diaphragm, the damper, and the like, another frame needs to be disposed on the front part of the diaphragm to mount the magnetic circuit.

Furthermore, because the diaphragm is coupled to a portion, projecting outward from the magnetic gap, of the voice coil unit disposed inside the magnetic gap formed in the magnetic circuit, the depth of the cone shaped space surrounded by the diaphragm must be set relatively large in order to ensure a space for the voice coil unit projecting outward from the magnetic gap. In addition, the length of the portion of the voice coil unit projecting outward from the magnetic gap, to which the diaphragm is coupled, cannot be made as small as it is desired because the amount of vibration of the diaphragm (the maximum vibration amount) must be taken into consideration for design. Therefore, thickness reduction is limited because the depth of the cone shaped space surrounded by the diaphragm needs to be made large to some extent and the amount of vibration of the diaphragm must be taken into consideration for designing the length of the portion, projecting outward from the magnetic gap, of the voice coil unit, for example.

Accordingly, the present invention has been devised in view of the foregoing circumstances and provides a lightweight and low-profile speaker apparatus.

SUMMARY

A speaker apparatus according to one embodiment of the present invention includes: a frame member having a shape rising outward from a bottom portion; a magnetic circuit including a recessed first yoke having a plate portion and a circumferential wall portion surrounding the plate portion; a magnet disposed inside the first yoke; a second yoke disposed such that the second yoke and the plate portion of the first yoke sandwich the magnet, and an annular magnetic gap is formed between the second yoke and the circumferential wall portion; a supporting member disposed on the bottom portion of the frame member for securing and supporting the magnetic circuit at the opposite circumferential end portion of the circumferential wall portion of the first yoke relative to the plate portion; a voice coil unit disposed inside the magnetic gap in the magnetic circuit; a coupling member disposed outward of the circumferential wall portion of the first yoke; and a diaphragm having its outer circumferential end portion coupled to the frame member and its inner circumferential end portion coupled to the coupling member. The voice coil unit and the coupling member are joined by a joint member that extends in a direction transverse to the circumferential wall portion of the first yoke, and an opening is formed at a predetermined location in each of the circumferential wall portion of the first yoke and the supporting member. The opening includes an area where the joint member joining the voice coil unit and the coupling member moves in correspondence with the vibration of the voice coil unit.

Such a structure eliminates a need to dispose another frame member to secure and support the magnetic circuit on the front part of the diaphragm, because the magnetic circuit including the first yoke, the magnet, and the second yoke is secured and supported by the supporting member disposed on the bottom portion of the frame member to which the outer circumferential portion of the diaphragm is coupled.

Furthermore, because the voice coil unit disposed inside the magnetic gap formed inward of the circumferential wall portion of the first yoke in the magnetic circuit and the coupling member disposed outward of the first yoke are joined by the joint member, and because the opening is formed at the predetermined location in each of the circumferential wall portion of the first yoke and the supporting member, including the area where the joint member joining the voice coil unit and the coupling member moves in correspondence with the vibration of the voice coil unit, the joint member can move inside the opening when the voice coil unit vibrates, and the coupling member to which the inner circumferential portion of the diaphragm is coupled can also vibrate in correspondence with the vibration of the voice coil unit. Furthermore, the position of the inner circumferential portion of the diaphragm can be set relatively close to the magnetic gap in the direction of vibration of the voice coil unit.

In the speaker apparatus according to one embodiment, the joint member joining the voice coil unit and the coupling member may be configured to include a plurality of joint pieces extending in directions transverse to the circumferential wall portion of the first yoke. In that case, a slit for each of the plurality of joint pieces to pass therethrough may be formed as the opening in each of the circumferential wall portion of the first yoke and the supporting member.

Furthermore, the speaker apparatus may have a structure in which the voice coil unit and the coupling member face each other across the circumferential wall portion of the first yoke. According to such a structure, the position of the inner circumferential portion of the diaphragm can be set closer to the magnetic gap in the direction of vibration of the voice coil unit disposed inside the magnetic gap, because the voice coil unit and the coupling member to which the inner circumferential portion of the diaphragm is coupled face each other across the circumferential wall portion of the first yoke. Accordingly, extra space in the vibration direction of the voice coil unit can be eliminated effectively.

Furthermore, the speaker apparatus may have a structure in which the supporting member is formed by cutting and raising the bottom portion of the frame member. According to such a structure, further weight reduction can be achieved, because it is not necessary to provide the supporting member on the bottom portion of the frame member as a separate member.

Furthermore, the speaker apparatus may have a structure in which a hole is formed passing through the bottom portion of the frame member and the supporting member. According to such a structure, because it is possible to insert a jigin which the first yoke, the magnet, and the second yoke, i.e., the magnetic circuit constituent components, and the voice coil unit have been assembled, into the hole formed passing through the bottom portion of the frame member and the supporting member, the magnetic circuit unit and the voice coil unit can be fit to the frame member by means of the jig. As a result, the components in the jig such as the magnetic circuit can be assembled together with the other components such as the diaphragm with ease and accuracy.

Furthermore, the speaker apparatus may have a structure in which a hole closing member is provided that closes the hole from outside the bottom portion of the frame member. According to such a structure, foreign objects entering through the hole can effectively be prevented, because the hole formed in the bottom portion of the frame member, which appears outside when the jig is removed upon completion of the assembly work, is closed by the hole closing member.

Furthermore, the speaker apparatus may have a structure in which the hole closing member includes a closing plate portion and a fitting portion to be fit into the hole. In the fitting portion, an opening that coincides with the opening formed in the supporting member is formed. According to such a structure, movement of the joint member joining the voice coil unit and the coupling member toward the supporting member is not impeded, because the opening formed in the fitting portion coincides with the opening formed in the supporting member when the hole is closed by means of the closing plate portion by fitting the fitting portion of the hole closing member into the hole formed in the bottom portion of the frame member and the supporting member. In other words, a larger vibration range can be maintained for the voice coil unit.

Furthermore, the speaker apparatus may have a structure in which an inner edge component that joins with the first yoke and resiliently supports the inner circumferential portion of the diaphragm and an outer edge component that joins with the outer peripheral portion of the frame member and resiliently supports the outer circumferential portion of the diaphragm are provided. In such a structure, the diaphragm extends in a state where the diaphragm is resiliently supported between the outer peripheral portion of the frame member and the first yoke that constitutes a part of the magnetic circuit.

In the speaker apparatus, because another frame member on the front part of the diaphragm to secure and support the magnetic circuit is not necessary, weight reduction can be achieved.

Furthermore, when the voice coil unit vibrates, the joint member that joins the voice coil unit and the coupling member across the circumferential wall portion of the first yoke can move in the opening formed in the circumferential wall portion and the supporting member, and the coupling member to which the inner circumferential portion of the diaphragm is coupled can also vibrate in correspondence with the vibration of the voice coil unit. In addition, because the inner circumferential portion of the diaphragm is positioned relatively close to the magnetic gap in the direction of vibration of the voice coil unit, extra space in the vibration direction of the voice coil unit can be reduced. Therefore, thickness reduction can be achieved.

DETAILED DESCRIPTION OF THE PREFERRED EMBODIMENTS

Embodiments of the present invention will now be described with reference to the drawings.

Figure 1A:
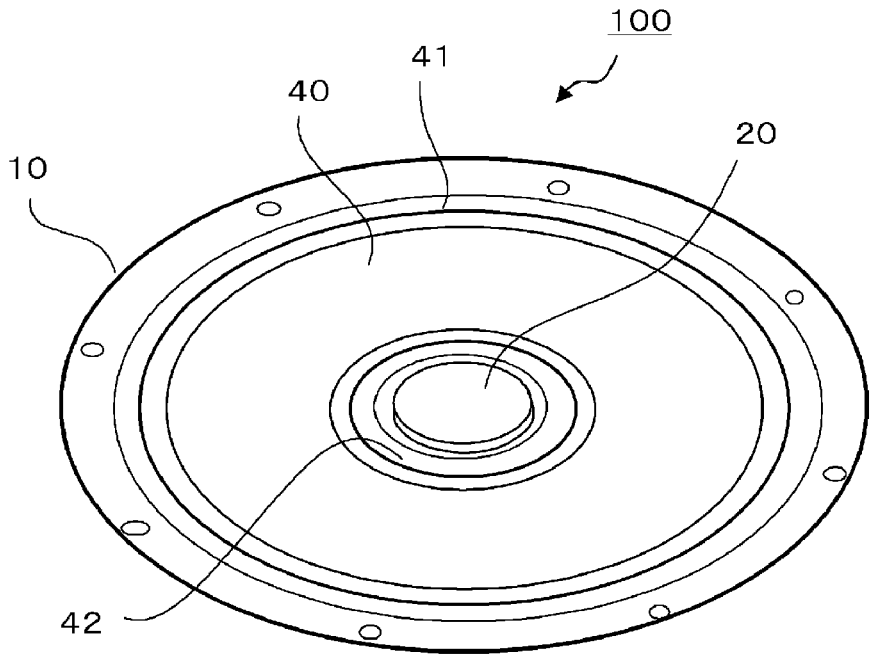
FIG. 1A is a front-side perspective view showing an external appearance of a speaker apparatus according to an embodiment of the invention.
Figure 1B:
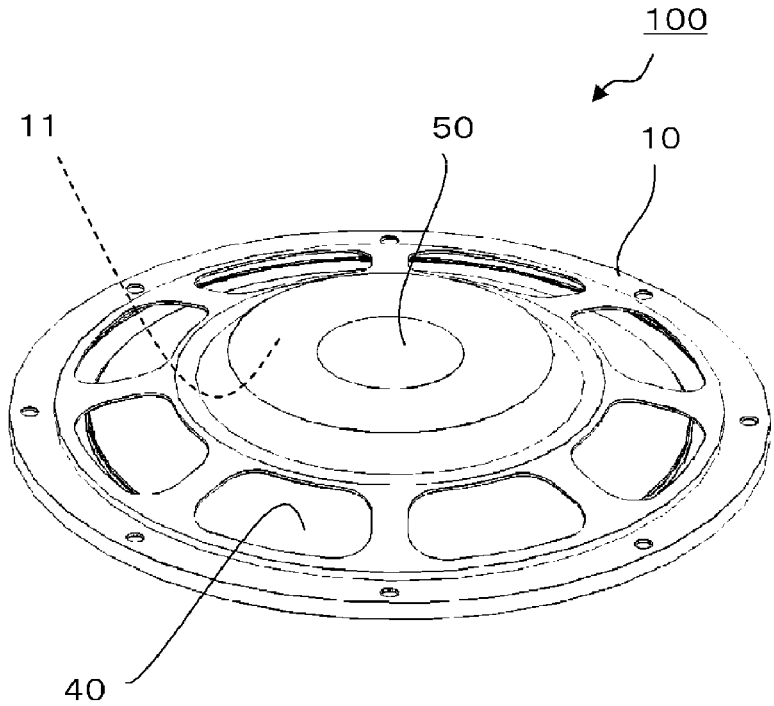
FIG. 1B is a rear-side perspective view showing an external appearance of the speaker apparatus according to an embodiment of the invention.

The external appearances of a speaker apparatus according to an embodiment of the invention as viewed from the front side and the rear side are shown in FIGS. 1A and 1B, respectively. This speaker apparatus 100 is formed by components shown in FIGS. 2 and 3, and has a sectional structure shown in FIGS. 4 and 5. Specifically, components including a frame member 10, a magnetic circuit assembly 20, a voice coil assembly 30, a diaphragm 40, an outer edge component 41, an inner edge component 42, a damper 43, and a bottom cap 50 are assembled to form the speaker apparatus 100.

Figure 2:
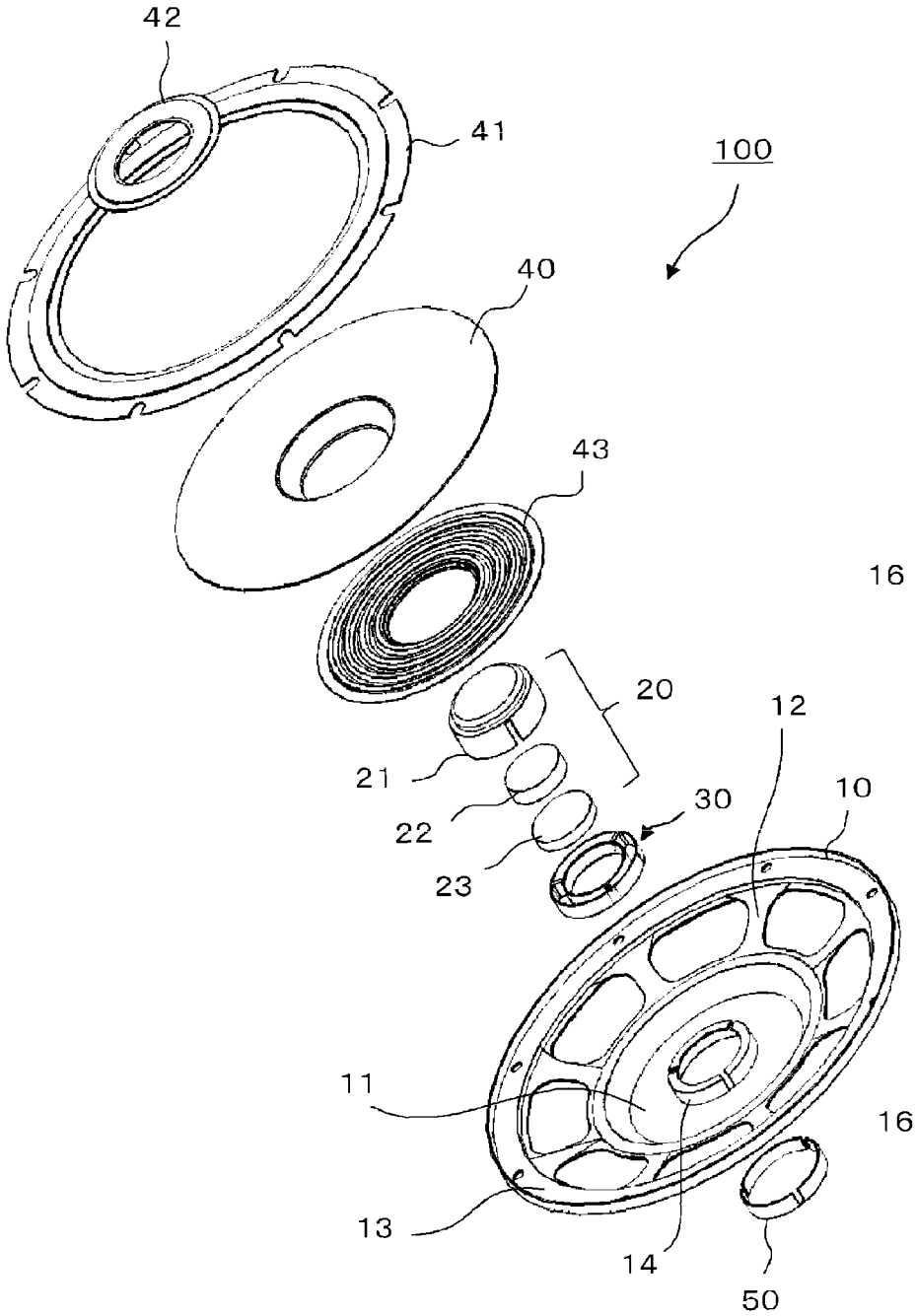
FIG. 2 is an exploded perspective view showing components constituting the speaker apparatus according to an embodiment of the invention.
Figure 3:
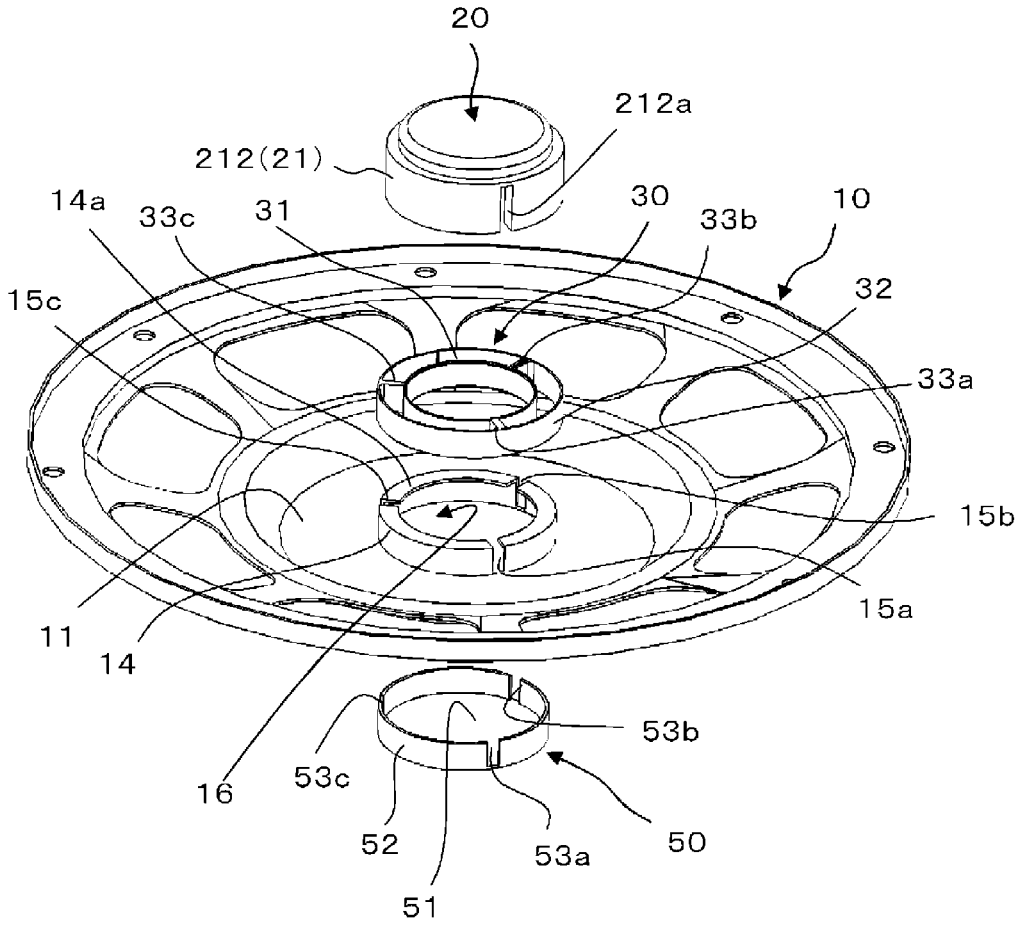
FIG. 3 is a perspective view showing the relation among a frame member having a supporting member formed on its bottom portion, a magnetic circuit assembly, a voice coil assembly, and a bottom cap.

As shown in FIG. 2, the frame member 10 has a circular cone shaped structure in which it rises outward from a bottom portion 11 to an outer peripheral portion 13 via a flare portion 12 formed therebetween. Furthermore, as shown in FIG. 3, a generally cylindrical supporting portion (a supporting member) 14 having an inwardly extending flange 14*a* on its tip is formed in the center of the bottom portion 11 of the frame member 10 through a cutting and raising operation, and a hole 16 is formed inside the supporting portion 14 passing through the bottom portion 11. Three slits 15*a*, 15*b*, and 15*c* extending in the height direction are formed at uniform angular intervals in the supporting portion 14. As shown in FIG. 2, the magnetic circuit assembly 20 is formed by a cup shaped (recessed) first yoke 21, a disc shaped magnet 22, and a disc shaped second yoke 23. As shown in FIG. 3, the voice coil assembly 30 is formed by a voice coil unit 31 and a coupling bobbin 32 co-axially disposed outward of the voice coil unit 31, and the voice coil unit 31 and the coupling bobbin 32 are integrally joined by joint pieces 33*a*, 33*b*, and 33*c* that are disposed at uniform intervals. The bottom cap 50 closes the hole 16 by fitting into the hole 16 formed in the bottom portion 11 of the frame member 10, and as shown in FIG. 3, the bottom cap is formed by a disc shaped closing plate portion 51 and a fitting portion 52 that surrounds the closing plate portion 51 in a wall-like manner. Three slits 53*a*, 53*b*, and 53*c* extending in the height direction are formed at uniform intervals in the fitting portion 52 of the bottom cap 50.

Figure 4:
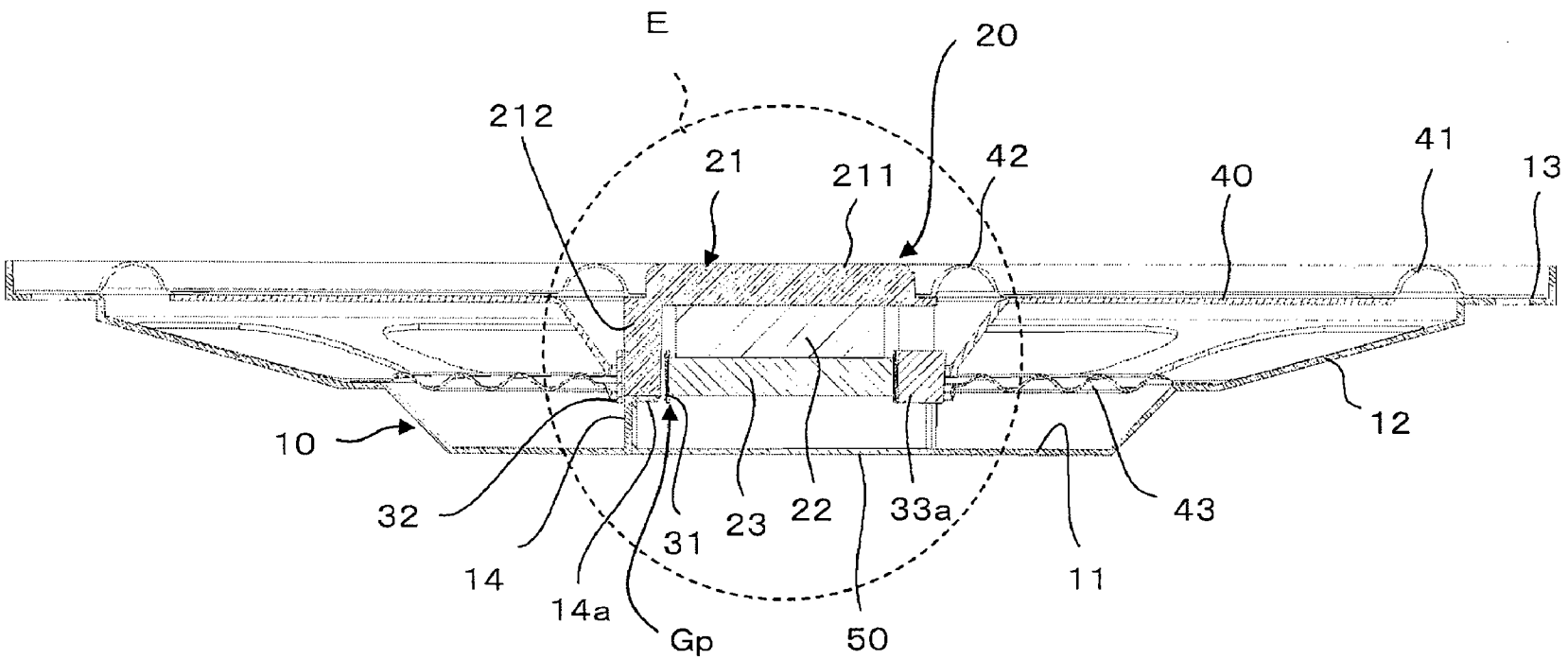
FIG. 4 is a sectional view showing a sectional structure of the speaker apparatus according to an embodiment of the invention.
Figure 5:
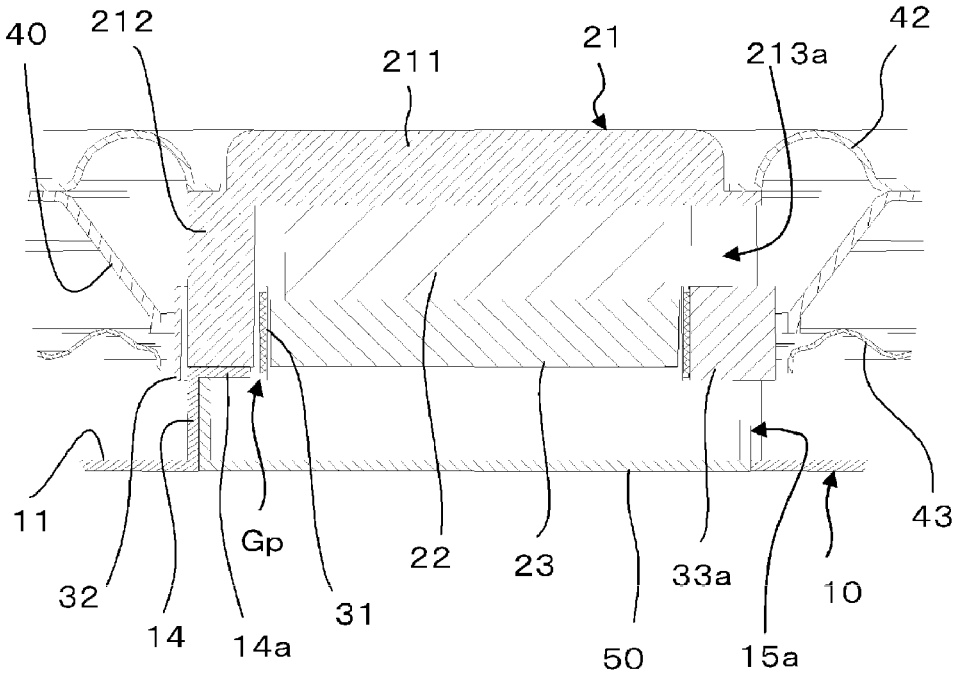
FIG. 5 is a partial enlarged sectional view showing the area E of FIG. 4 on an enlarged scale.

Assembly procedures and more detailed structures of these components will now be described with reference to FIGS. 6 to 17, together with FIGS. 4 and 5 showing their sectional structure.

Figure 6:
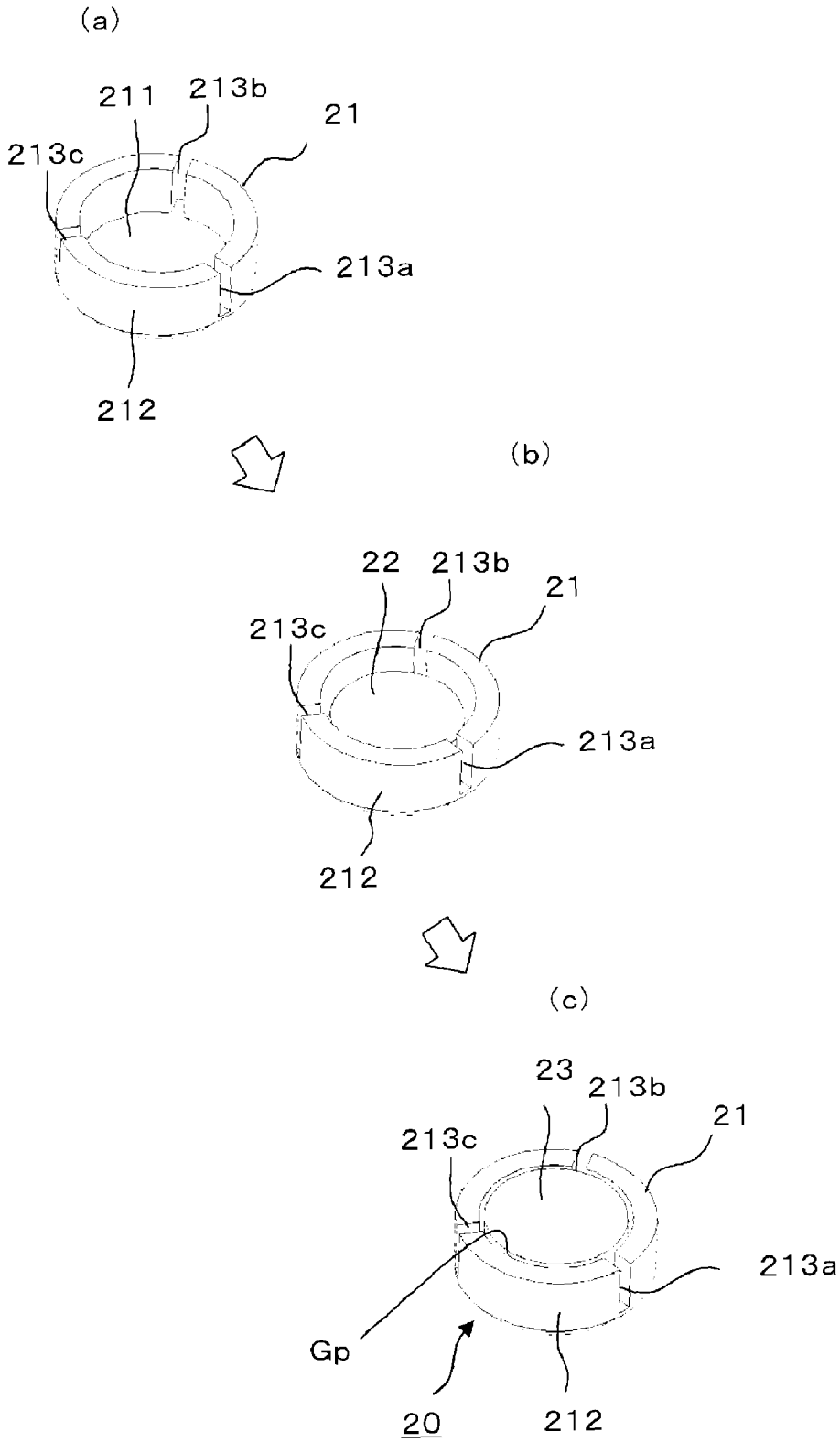
FIG. 6 is a view showing a portion of a procedure for assembling the speaker apparatus according to an embodiment of the invention (Part 1).

As shown in FIG. 6(*a*), the first yoke 21 that constitutes a part of the magnetic circuit assembly 20 is formed as a cup-like shape (a recessed shape) by a disc shaped plate portion 211 and a circumferential wall portion 212 surrounding the plate portion 211. In the circumferential wall portion 212, three slits 213*a*, 213*b*, and 213*c* extending in the height direction from the circumferential end surface of the circumferential wall portion to the plate portion 211 are formed at uniform intervals. As shown in FIG. 6(*b*), the disc shaped magnet 22 that is slightly smaller than the plate portion 211 of the first yoke 21 is set inside the first yoke 21, and as shown in FIG. 6(*c*), the disc shaped second yoke 23 having a slightly smaller area than the inner sectional area of the circumferential wall portion 212 of the first yoke 21 is set such that the second yoke 23 and the plate portion 211 sandwich the magnet 22 therebetween. In this manner, the magnetic circuit assembly 20 having a magnetic gap Gp formed is formed between the inner circumferential surface of the circumferential wall portion 212 of the first yoke 21 and the outer circumferential surface of the second yoke 23. It should be noted that the height of the circumferential wall portion 212 of the first yoke 21, the thickness of the magnet 22, and the thickness of the second yoke 23 are set such that the circumferential end surface of the circumferential wall portion 212 of the first yoke 21 is flush with the surface of the second yoke 23 opposite the magnet 22 (see FIGS. 4 and 5). Furthermore, the first yoke 21, the magnet 22, and the second yoke 23 are assembled using a jig for maintaining the magnetic gap Gp and secured by an adhesive.

Figure 7:
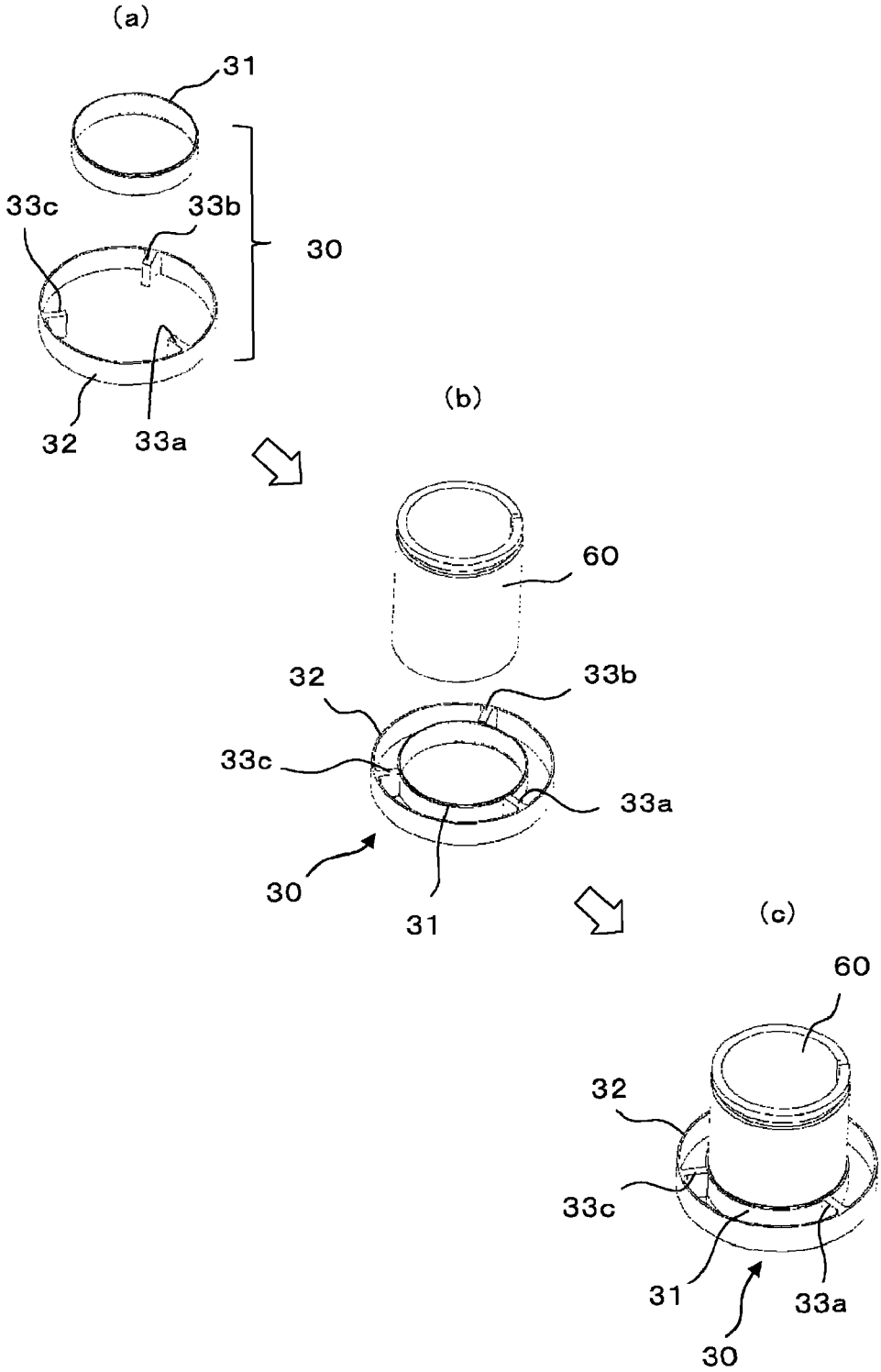
FIG. 7 is a view showing a portion of the procedure for assembling the speaker apparatus according to an embodiment of the invention (Part 2).

As shown in FIG. 7(*a*), the voice coil assembly 30 includes a voice coil unit 31 having a structure in which a voice coil is wound around an annular bobbin, and an annular coupling bobbin (a coupling member) 32 having the same height as that of the voice coil unit 31. Three joint pieces (joint members) 33*a*, 33*b*, and 33*c* are formed at uniform intervals on the inner circumferential surface of the coupling bobbin 32. The projecting length of each of these three joint pieces 33*a*, 33*b*, and 33*c* from the inner circumferential surface of the coupling bobbin 32 is determined such that the tips of the three joint pieces 33*a*, 33*b*, and 33*c* are in contact with the outer circumferential surface of the voice coil unit 31 when set inside the coupling bobbin 32. Then, as shown in FIG. 7(*b*), the voice coil unit 31 is co-axially set inside the coupling bobbin 32, and the tips of the three joint pieces 33*a*, 33*b*, and 33*c* and the voice coil unit 31 are secured by an adhesive. In this manner, the voice coil assembly 30 is formed having a structure in which the voice coil unit 31 and the coupling bobbin 32 are joined by the three joint pieces 33*a*, 33*b*, and 33*c*. It is preferable that the coupling bobbin (the coupling member) 32 and the joint pieces (the joint members) 33*a*, 33*b*, and 33*c* be integrally formed of a non-magnetic material such as aluminum, through a die casting operation.

Next, as shown in FIG. 7(*b*), a cylindrical jig 60 is provided, and as shown in FIG. 7(*c*), the jig 60 is fitted into the annular voice coil unit 31.

Figure 8:
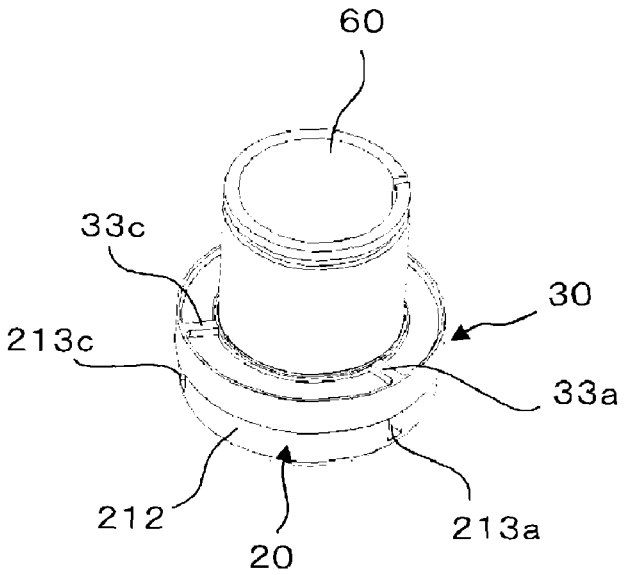
FIG. 8 is a view showing a portion of the procedure for assembling the speaker apparatus according to an embodiment of the invention (Part 3).

Once the voice coil assembly 30 is fit to the jig 60 in this manner, the voice coil assembly 30 with the jig 60 is fit to the magnetic circuit assembly 20 as shown in FIG. 8. In that state, the voice coil unit 31 is positioned inside the magnetic gap Gp formed inward of the circumferential wall portion 212 of the first yoke 21 in the magnetic circuit assembly 20, and the coupling bobbin 32 is positioned outward of the circumferential wall portion 212 of the first yoke 21, the voice coil unit 31 and the coupling bobbin 32 facing each other across the circumferential wall portion 212 of the first yoke 21 therebetween (see FIGS. 4 and 5). Furthermore, the three joint pieces 33*a*, 33*b*, and 33*c* joining the voice coil unit 31 and the coupling bobbin 32 penetrate the circumferential wall portion 212 of the first yoke 21 through the slits 213*a*, 213*b*, and 213*c* (see FIGS. 4 and 5).

Figure 9:
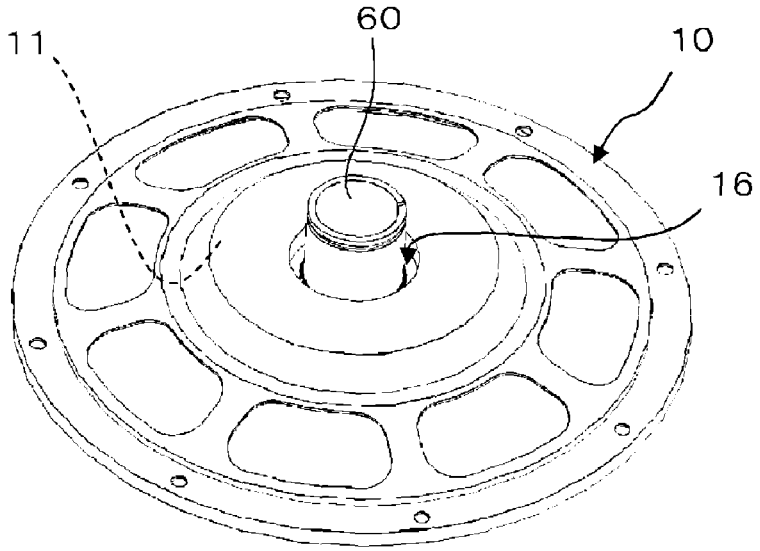
FIG. 9 is a view showing a portion of the procedure for assembling the speaker apparatus according to an embodiment of the invention (Part 4).

Then, the jig 60, to which the voice coil assembly 30 and the magnetic circuit assembly 20 have been attached as shown in FIG. 8, is set inside the frame member 10 through the hole 16 from the bottom portion 11 of the frame member 10 as shown in FIG. 9. In that state, the magnetic circuit assembly 20 is in contact with the supporting portion 14 formed on the bottom portion 11 of the frame member 10 in a manner that the second yoke 23 oriented in a direction opposite to that shown in FIG. 6(*c*) faces the supporting portion 14. Specifically, the circumferential end surface of the circumferential wall portion 212 of the first yoke 21 in the magnetic circuit assembly 20 is in contact with the inwardly extending flange 14*a* of the supporting portion 14 formed on the bottom portion 11 of the frame member 10. The magnetic circuit assembly 20 is secured and supported by the supporting portion 14 because the circumferential end surface of the circumferential wall portion 212 of the magnetic circuit assembly 20 is adhesively secured to the inwardly extending flange 14*a* of the supporting portion 14 (see FIGS. 4 and 5). The three slits 213*a*, 213*b*, and 213*c* formed in the circumferential wall portion 212 of the first yoke 21 in the magnetic circuit assembly 20 are aligned with the three slits 15*a*, 15*b*, and 15*c* formed in the supporting portion 14 to form three slits (213*a*, 15*a*), (213*b*, 15*b*), and (213*c*, 15*c*) extending from the circumferential wall portion 212 of the first yoke 21 to the supporting portion 14.

Figure 10:
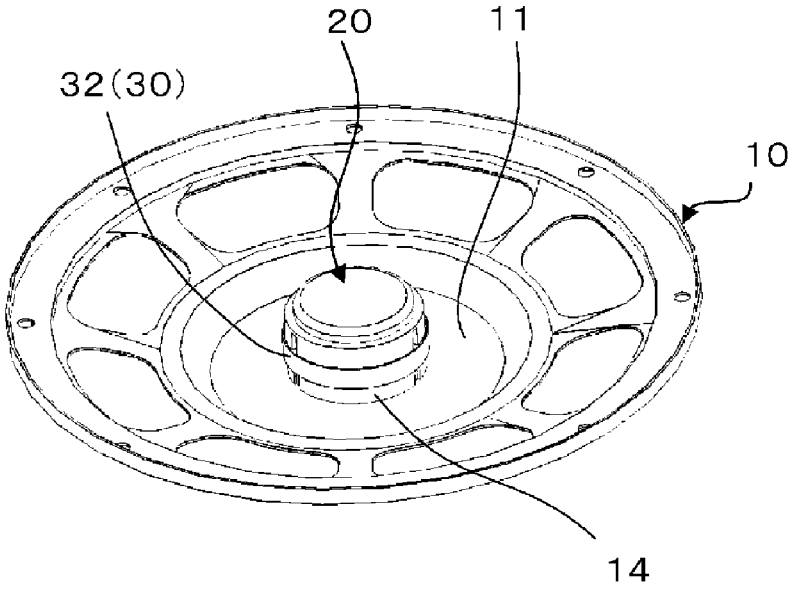
FIG. 10 is a view showing a portion of the procedure for assembling the speaker apparatus according to an embodiment of the invention (Part 5).

The frame member 10, to which the jig 60 attached with the voice coil assembly 30 and the magnetic circuit assembly 20 is set as described above, is inverted from the state shown in FIG. 9 into the state shown in FIG. 10. In that state, the magnetic circuit assembly 20 secured and supported by the supporting portion 14 formed on the bottom portion 11 of the frame member 10 and the coupling bobbin 32 of the voice coil assembly 30 disposed outward of the magnetic circuit assembly 20 appears outside.

Figure 11:
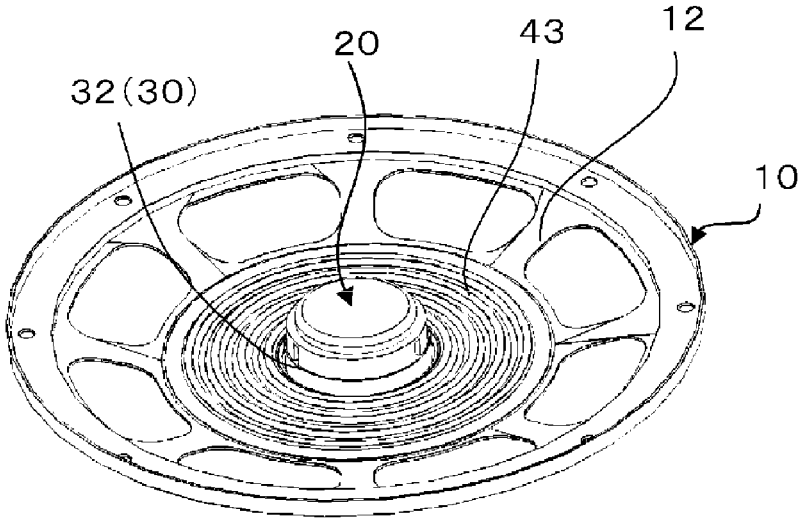
FIG. 11 is a view showing a portion of the procedure for assembling the speaker apparatus according to an embodiment of the invention (Part 6).

Next, as shown in FIG. 11, the outer circumferential end portion of the damper 43 is adhesively secured to the flare portion 12 of the frame member 10 at a predetermined location thereof, and the inner circumferential end portion of the damper 43 is adhesively secured to the coupling bobbin 32 disposed outward of the magnetic circuit assembly 20. In this manner, the voice coil unit 31 joined to the coupling bobbin 32 by the three joint pieces 33*a*, 33*b*, and 33*c* is resiliently supported by the damper 43 (see FIGS. 4 and 5).

Figure 12:
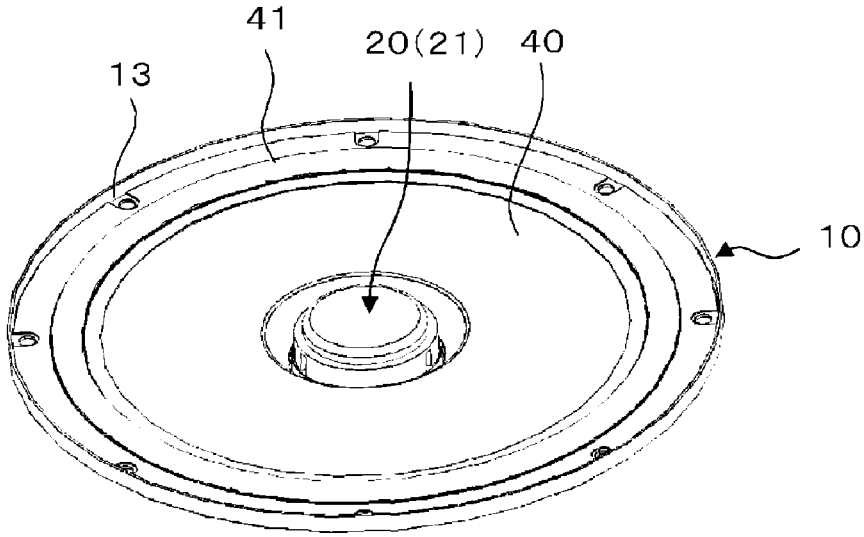
FIG. 12 is a view showing a portion of the procedure for assembling the speaker apparatus according to an embodiment of the invention (Part 7).

As shown in FIGS. 2 and 4, the diaphragm 40 extends horizontally from its outer circumferential end portion toward the inside thereof, and from a predetermined inside location extends downward to the inner circumferential end portion thereof. As shown in FIG. 12, the inner end portion of the outer edge component 41 is adhesively secured to the outer circumferential end portion of the diaphragm 40 having the described structure, and the outer end portion of the outer edge component 41 is adhesively secured to the outer peripheral portion 13 of the frame member 10. In this manner, the outer circumferential end portion of the diaphragm 40 is resiliently supported by the outer edge component 41. Furthermore, the inner circumferential end portion of the diaphragm 40 is adhesively secured to the coupling bobbin 32 disposed outward of the magnetic circuit assembly 20 (see FIGS. 4 and 5). As a result, the diaphragm 40 is allowed to vibrate due to back-and-forth movement (vibration) of the coupling bobbin 32 associated with back-and-forth movement (vibration) of the voice coil unit 31 within the magnetic gap Gp.

Figure 13:
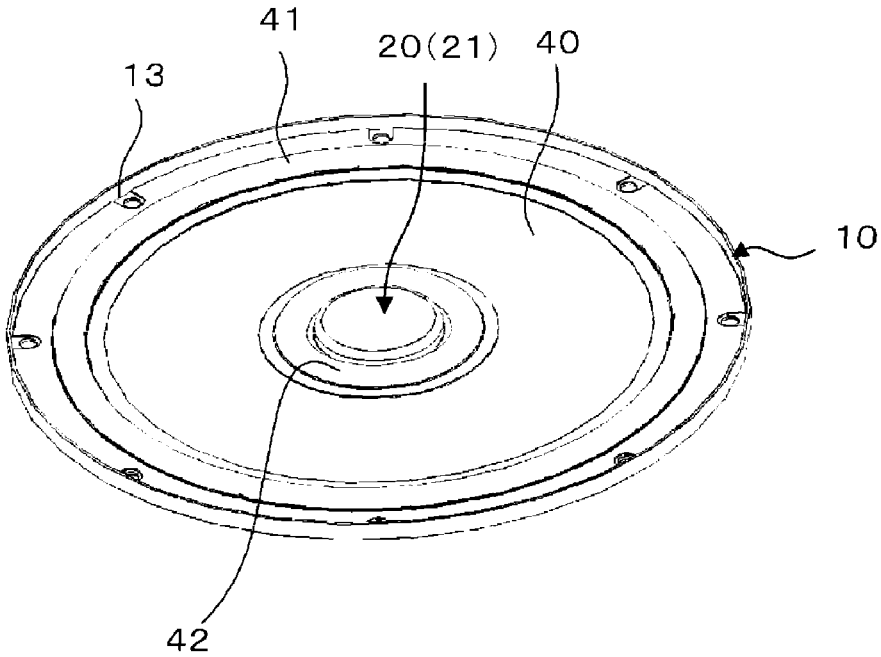
FIG. 13 is a view showing a portion of the procedure for assembling the speaker apparatus according to an embodiment of the invention (Part 8).

Then, as shown in FIG. 13, the inner end portion of the inner edge component 42 is adhesively secured to the interface portion between the plate portion 211 and the circumferential wall portion 212 of the first yoke 21 in the magnetic circuit assembly 20, and the outer end portion of the inner edge component 42 is adhesively secured to the inner peripheral portion of the horizontal portion of the diaphragm 40 (see FIG. 4). In this manner, a portion proximate to the inner end portion, which is coupled to the coupling bobbin 32, of the diaphragm 40 is resiliently supported by the inner edge component 42.

Figure 14:
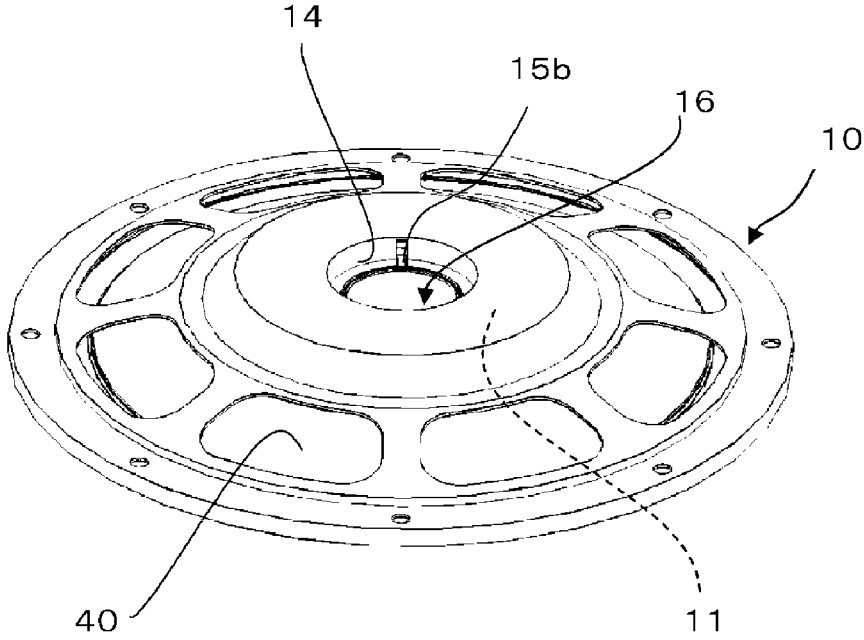
FIG. 14 is a view showing a portion of the procedure for assembling the speaker apparatus according to an embodiment of the invention (Part 9).
Figure 15:
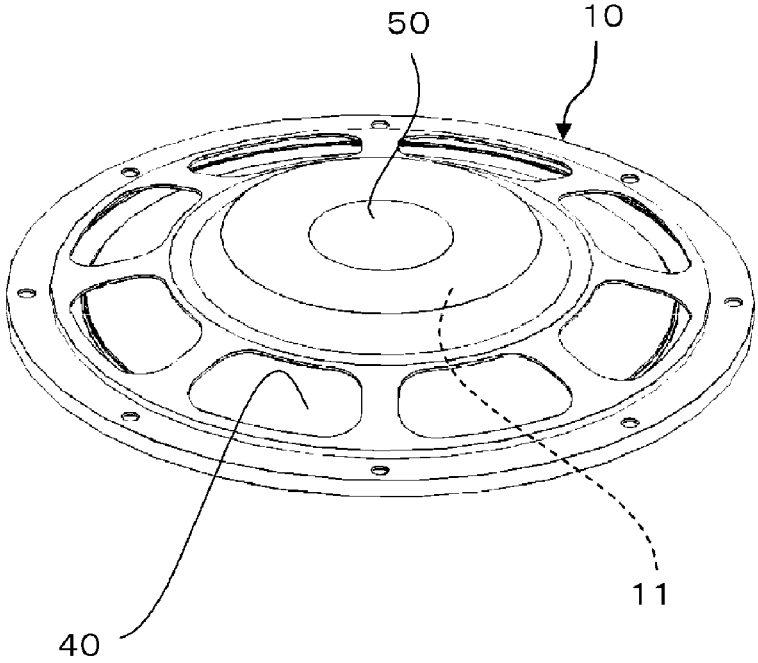
FIG. 15 is a view showing a portion of the procedure for assembling the speaker apparatus according to an embodiment of the invention (Part 10).

In that state, when the frame member 10 is inverted and the jig 60 is removed from the hole 16, the hole 16 formed in the bottom portion 11 of the frame member 10 appears outside as shown in FIG. 14. A state is maintained where the magnetic circuit assembly 20, to which the voice coil assembly 30 has been integrally mounted, is secured and supported by the supporting portion 14 on the bottom portion 11 (see FIGS. 4 and 5). Then, the bottom cap 50 is fitted into the hole 16 in a manner that the slits 53*a*, 53*b*, and 53*c* coincide with the slits 15*a*, 15*b*, and 15*c* in the supporting portion 14. As a result, the hole 16 formed in the bottom portion 11 of the frame member 10 is closed.

In this manner, the speaker apparatus 100 having the external appearances shown in FIGS. 1A and 1B and the internal structure shown in FIGS. 4 and 5 is completed.

Figure 16:
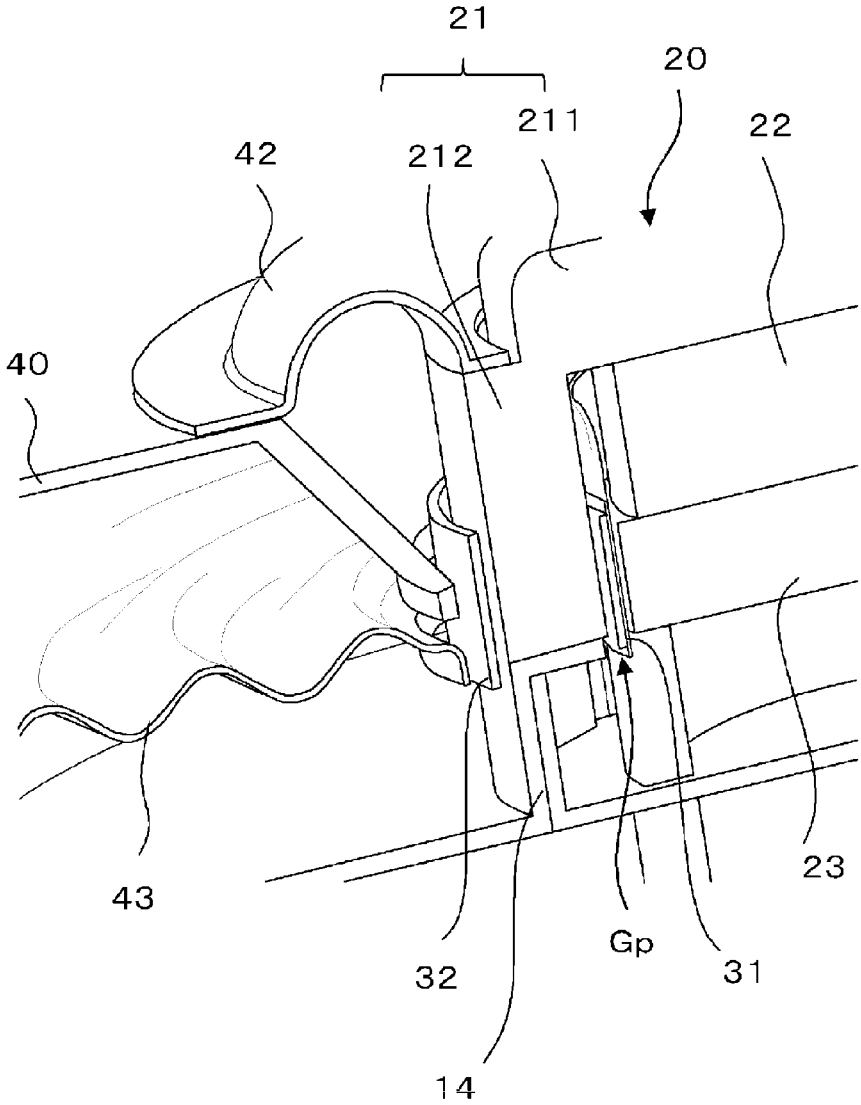
FIG. 16 is a cutaway partial perspective view showing the relative positional relation between a voice coil unit and a coupling bobbin, and a structure for securing the inner circumferential end portion of a diaphragm.
Figure 17:
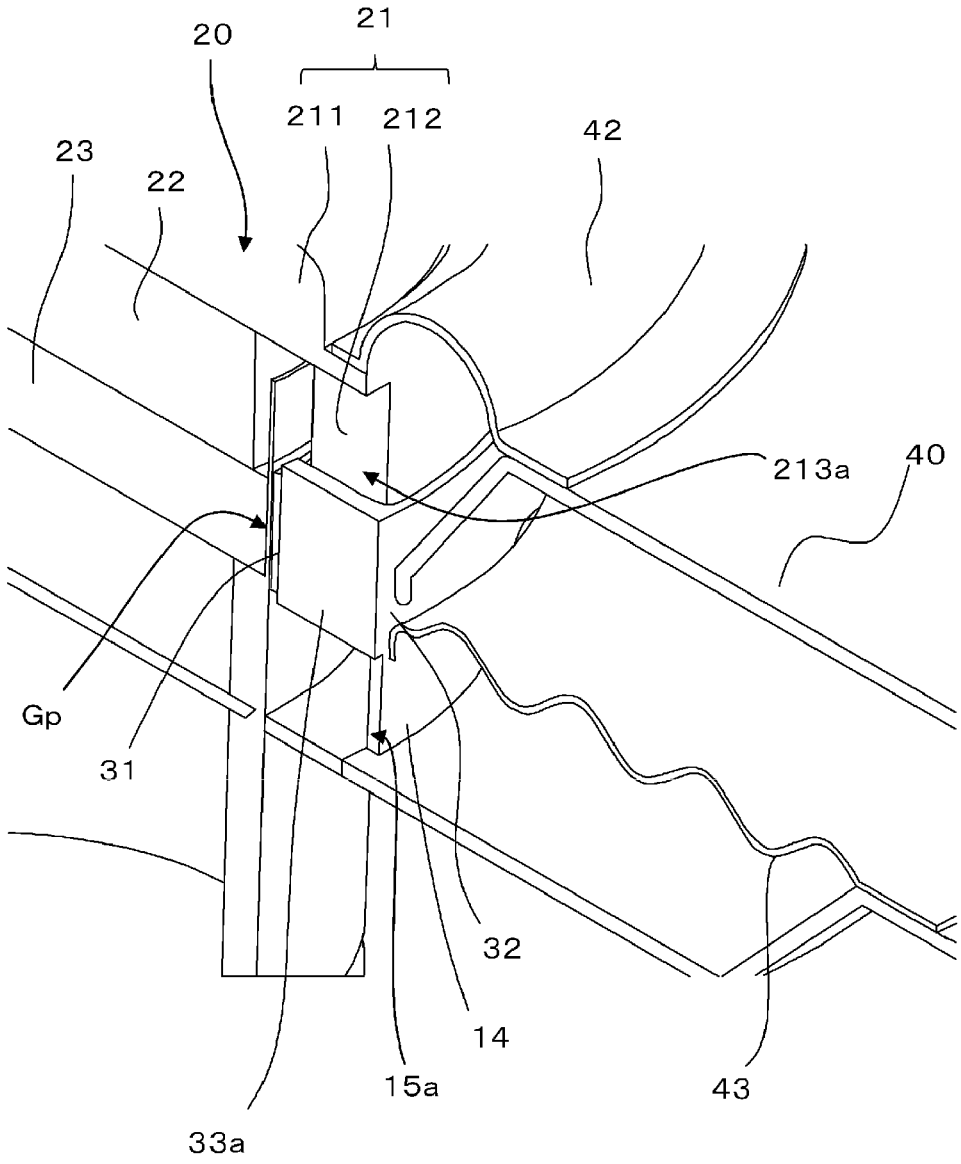
FIG. 17 is a cutaway partial perspective view showing the positional relation of a joint piece joining the coupling bobbin, to which the inner circumferential end portion of the diaphragm is coupled, and the voice coil unit.

In such a speaker apparatus 100, when a sound signal is supplied to the voice coil of the voice coil unit 31, a force is applied to the voice coil unit 31 to move back and forth (vibrate) within the magnetic gap Gp due to interaction between the sound signal electric current flowing through the voice coil and a transverse magnetic flux in the magnetic gap Gp of the magnetic circuit assembly 20. At that time, as shown in FIG. 16, a similar force is applied to the coupling bobbin 32 that faces the voice coil unit 31 across the circumferential wall portion 212 of the first yoke 21 in the magnetic circuit assembly 20, via the joint pieces 33*a*, 33*b*, and 33*c*. As a result, because each of the joint pieces 33*a* (33*b*, 33*c*) is allowed to move within the slit 213*a* (213*b*, 213*c*) formed in the circumferential wall portion 212 of the first yoke 21 and the slit 15*a* (15*b*, 15*c*) formed in the supporting portion 14 as shown in FIG. 17, the voice coil unit 31 and the coupling bobbin 32 joined to the voice coil unit 31 by the joint pieces 33*a*, 33*b*, 33*c* move back and forth (vibrate) integrally when a force based on a sound signal is applied to the voice coil unit 31. Then, this vibration of the coupling bobbin 32 vibrates the diaphragm 40, thereby outputting sound corresponding to the sound signal.

Because this speaker apparatus 100 has a structure in which the magnetic circuit assembly 20 is secured and supported by the supporting portion 14 formed on the bottom portion 11 of the frame member 10, it is not necessary to dispose another frame member on the front part of the diaphragm, unlike conventional so-called counter drive type speaker apparatuses. Accordingly, weight reduction can be achieved.

Furthermore, because the coupling bobbin 32, to which the inner circumferential end portion of the diaphragm 40 is coupled, faces the voice coil unit 31 disposed in the magnetic gap Gp of the magnetic circuit assembly 20 as shown in FIG. 16, the position of the inner circumferential end portion of the diaphragm 40 is substantially same as the position of the magnetic gap Gp in the vibration direction of the voice coil unit 31. For this reason, extra space in the direction of vibration of the voice coil unit 31 can be reduced to the maximum extent.

Figure 18:
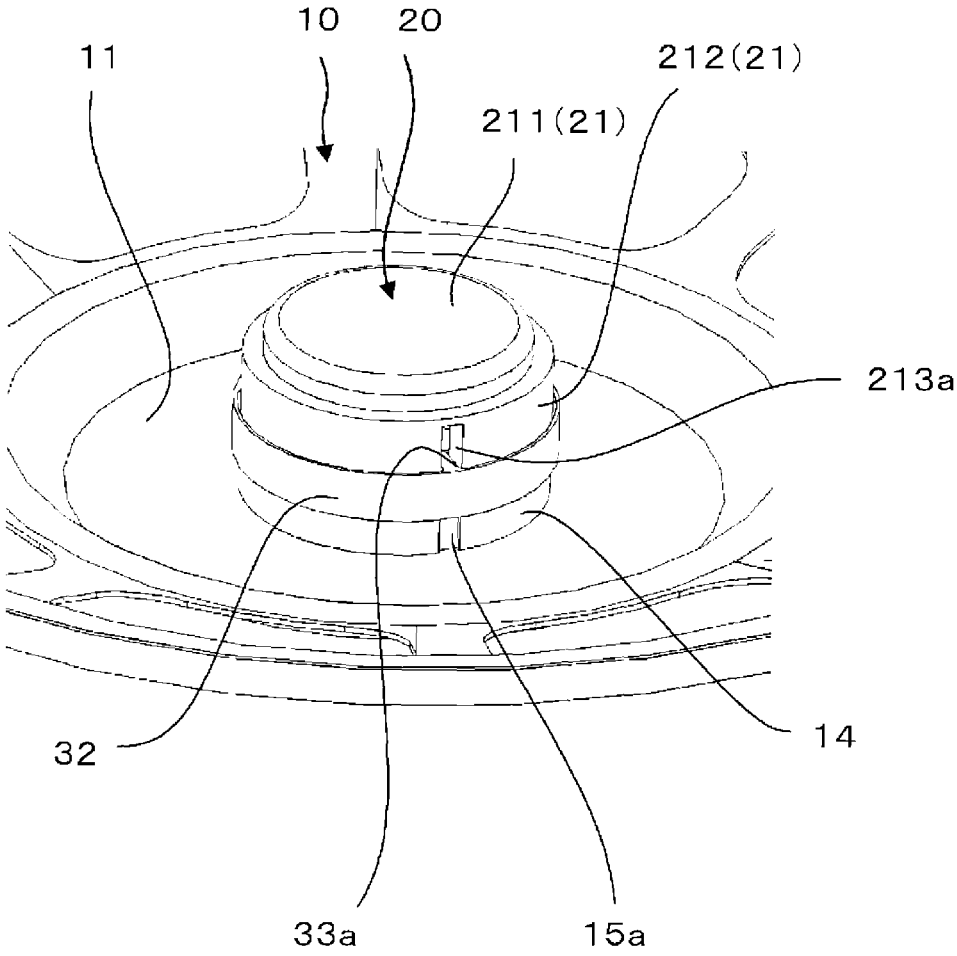
FIG. 18 is a partial perspective view showing the state of the coupling bobbin in a stationary state of the voice coil unit.
Figure 19:
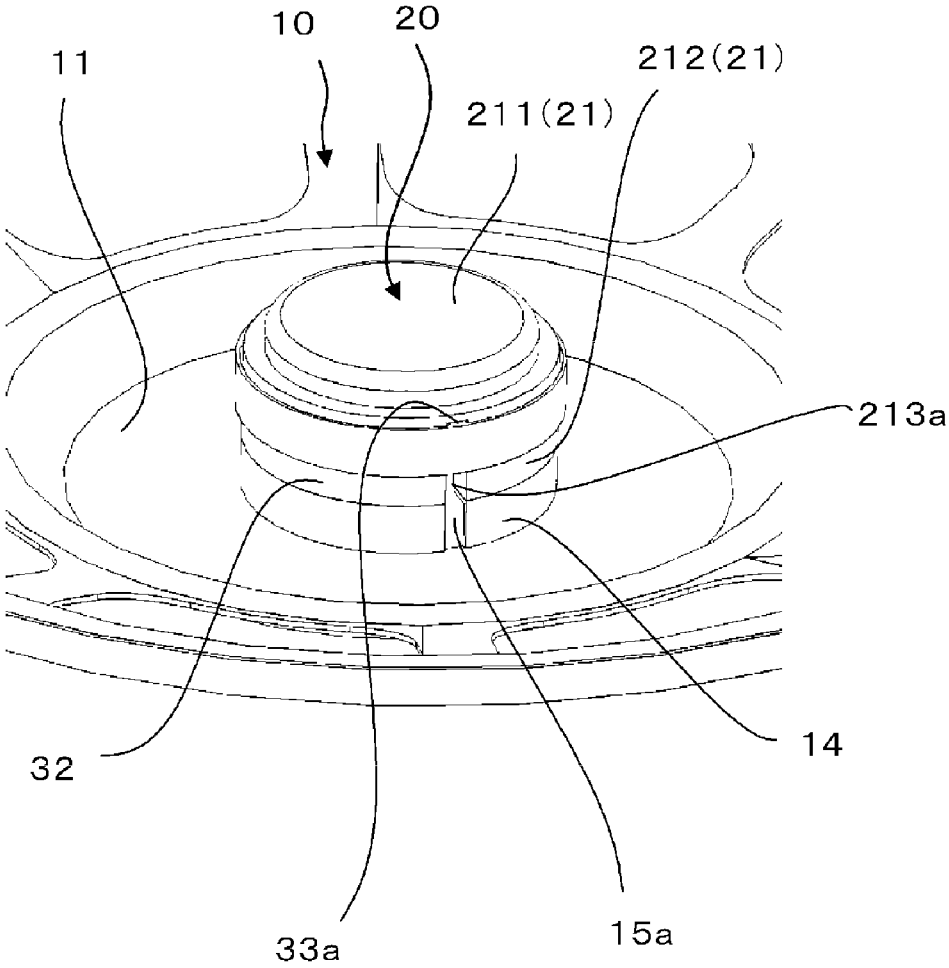
FIG. 19 is a partial perspective view showing the state of the coupling bobbin in a state where the voice coil unit has advanced to the maximum extent.
Figure 20:
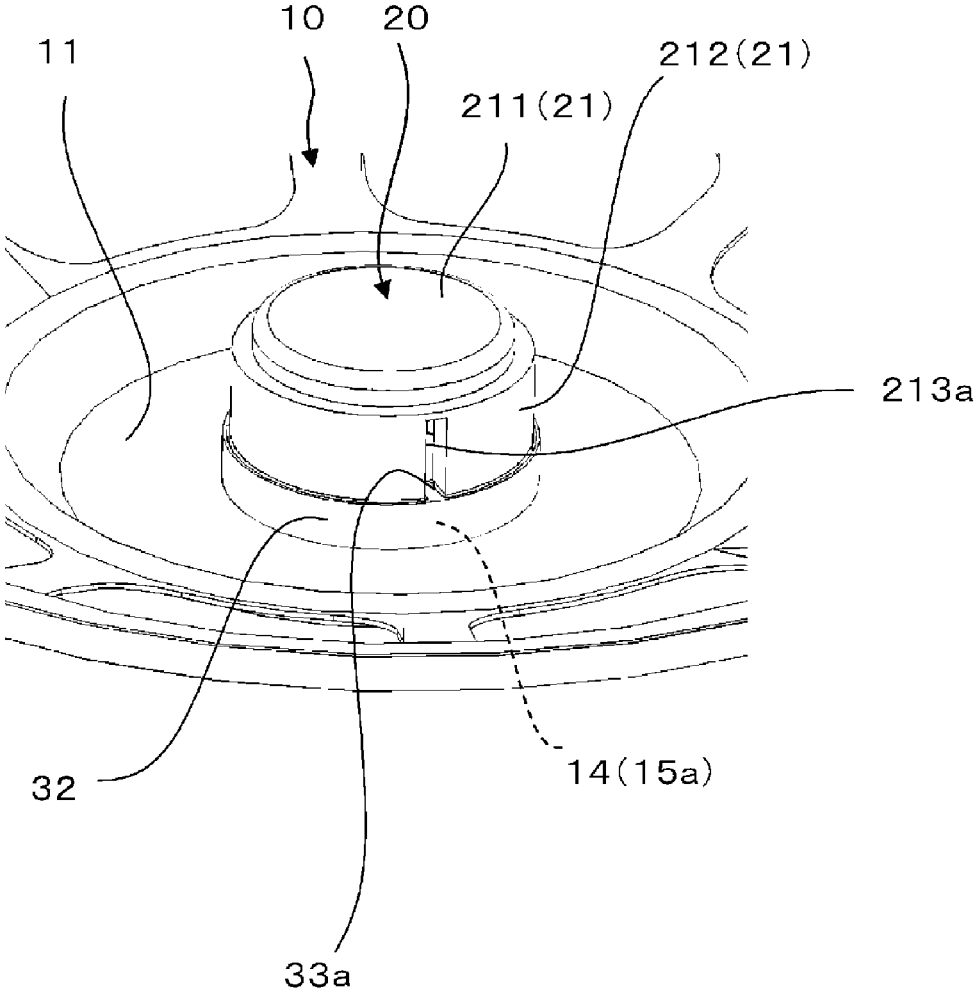
FIG. 20 is a partial perspective view showing the state of the coupling bobbin in a state where the voice coil unit has retracted to the maximum extent.

The range of the back-and-forth movement of the coupling bobbin 32 associated with the back-and-forth movement of the voice coil unit 31 may be represented as shown in FIGS. 18 to 20, for example. Specifically, when the voice coil unit 31 is in a stationary state, the coupling bobbin 32 (the voice coil unit 31) is positioned at the interface portion between the circumferential wall portion 212 of the first yoke 21 in the magnetic circuit assembly 20 and the supporting portion 14 as shown in FIG. 18. In a state where the voice coil unit 31 has advanced to the maximum extent, the coupling bobbin 32 (the voice coil unit 31) is positioned at a location near an end portion on the side of the plate portion 211, of the circumferential wall portion 212 of the first yoke 21 as shown in FIG. 19. In a state where the voice coil unit 31 has retracted to the maximum extent, the coupling bobbin 32 (the voice coil unit 31) is positioned outward of the supporting unit 14 that secures and supports the magnetic circuit assembly 20, as shown in FIG. 20.

The thickness of the speaker apparatus 100 is determined in accordance with the amount of deformation of the diaphragm 40 in the vibration direction of the voice coil unit 31 when the coupling bobbin 32 moves back and forth within the range shown in FIGS. 18 to 20, in a state where extra space in the direction of vibration of the voice coil unit 31 has been reduced to the maximum extent as described above. As a result, further thickness reduction of the speaker apparatus 100 can be achieved.

Furthermore, an excellent dustproof capability can be achieved because the front surface of the speaker apparatus 100 is covered by the diaphragm 40, the outer edge component 41, and the inner edge component 42, and the hole 16 formed in the bottom portion 11 of the frame member 10 is closed by the bottom cap 50.

It is to be noted that the supporting member that supports the magnetic circuit assembly 20 is not necessarily the supporting portion 14 formed by cutting and raising the bottom portion 11 of the frame member 10 as described above. A supporting member different from the frame member 10 may also be provided on the bottom portion 11 of the frame member 10. Furthermore, the supporting portion 14 formed on the bottom portion 11 of the frame member 10 may be omitted in the configuration of the magnetic circuit assembly 20 as shown in FIGS. 21 and 22.

Figure 21:
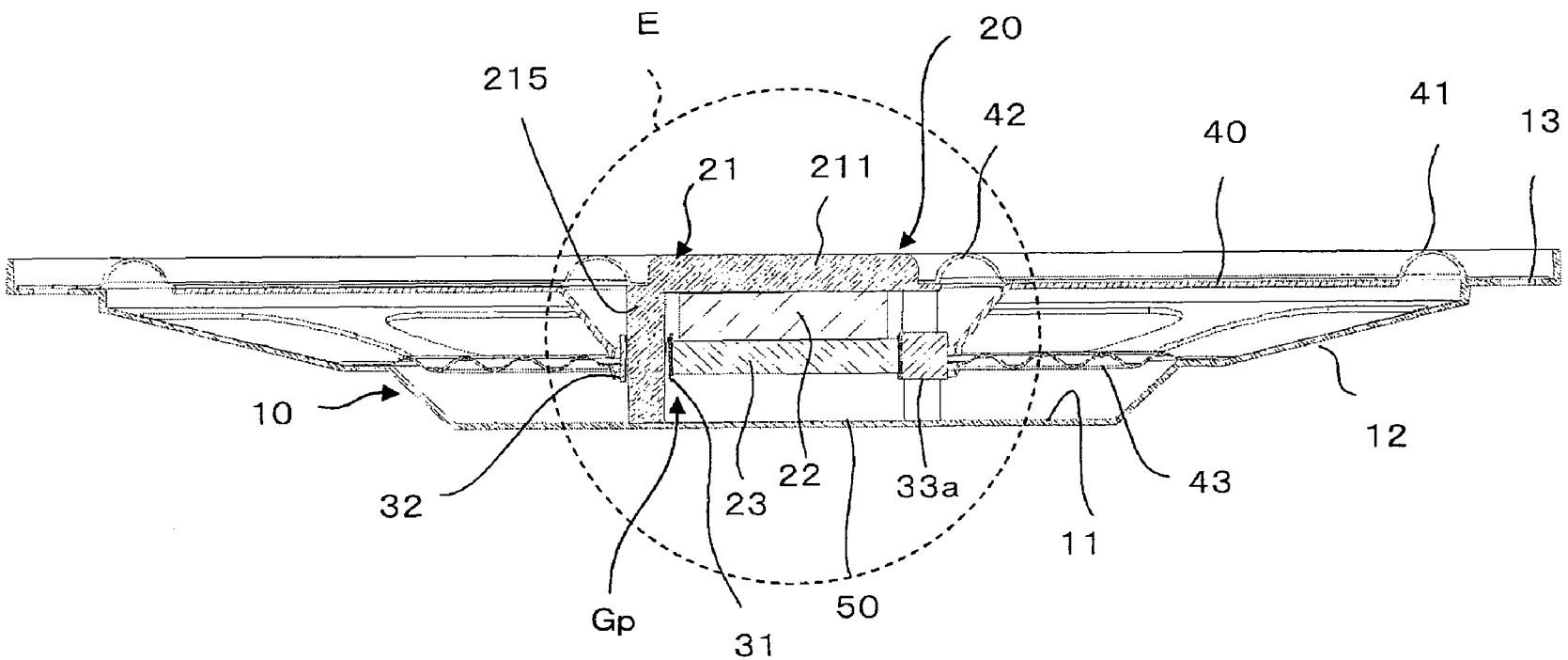
FIG. 21 is a sectional view showing another structure for supporting the magnetic circuit assembly.
Figure 22:
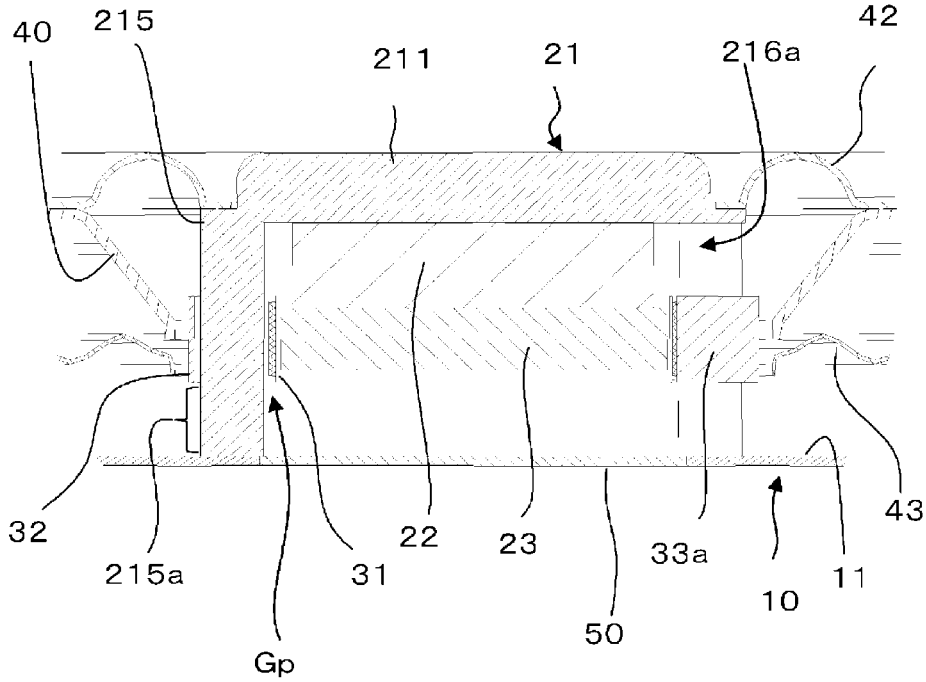
FIG. 22 is an enlarged partial sectional view showing the area E of FIG. 21 on an enlarged scale.

Referring to FIGS. 21 and 22, in this speaker apparatus, the magnetic circuit assembly 20 is basically formed by the cup shaped (recessed) first yoke 21, the magnet 22, and the second yoke 23, as is the case with the above described embodiment. Furthermore, the first yoke 21 is formed by the plate portion 211 and a circumferential wall portion 215 as is the case with the above described embodiment, but the structure is different between the circumferential wall portion 215 and the circumferential wall portion 212 in the above described embodiment. Specifically, the height of the circumferential wall portion 215 is larger than the height of the circumferential wall portion 212 in the above described embodiment. The circumferential wall portion 215 projects beyond the level of the opposite surface of the second yoke 23 relative to the magnet 22 by an amount in accordance with the height of the supporting portion 14 in the above described embodiment. As a result, this projecting portion 215*a* (see FIG. 22) of the circumferential wall portion 215 of the first yoke 21 functions as a supporting member that secures and supports the portion (the portion up to the second yoke 23) that functions as the original magnetic circuit.

The circumferential end surface of the circumferential wall portion 215 of the first yoke 21 is adhesively secured directly to the bottom portion 11 of the frame member 10 by an adhesive. In this manner, a space (which corresponds to the height of the supporting portion 14 in the above described embodiment) that allows movement of the voice coil unit 31 is formed between the second yoke 23 and the bottom portion 11 of the frame member 10. Although not shown clearly in FIGS. 21 and 22, three slits including a slit 216*a* are formed at uniform intervals in the circumferential wall portion 215. Furthermore, as is the case with the above described embodiment, three joint pieces 33*a* (33*b*, 33*c*) joining the coupling bobbin 32, to which the inner end portion of the diaphragm 40 is secured, and the voice coil unit 31 are disposed inside the three slits (including the slit 216*a*). As a result, the coupling bobbin 32 can move back and forth within the range shown in FIGS. 18 to 20 along with moving back and forth of the voice coil unit 31.

As described above, the speaker apparatus according to the invention is useful as a speaker apparatus that outputs sound through the vibration of a diaphragm coupled to a voice coil due to interaction between a magnetic field generated in a magnetic circuit and a sound signal electric current flowing through the voice coil, because of its light weight and low profile.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker apparatus, comprising:

a frame member having a shape rising outward from a bottom portion;

a magnetic circuit including a recessed first yoke having a plate portion and a circumferential wall portion surrounding the plate portion, a magnet disposed inside the first yoke, and a second yoke disposed such that the second yoke and the plate portion of the first yoke sandwich the magnet and an annular magnetic gap is formed between the second yoke and the circumferential wall portion;

a supporting member disposed on the bottom portion of the frame member for securing and supporting the magnetic circuit at an opposite circumferential end portion of the circumferential wall portion of the first yoke relative to the plate portion;

a voice coil unit disposed inside the magnetic gap in the magnetic circuit;

a coupling member disposed outward of the circumferential wall portion of the first yoke; and a diaphragm having its outer circumferential end portion coupled to the frame member and its inner circumferential end portion coupled to the coupling member, wherein the voice coil unit and the coupling member are joined by a joint member that extends in a direction transverse to the circumferential wall portion of the first yoke, and an opening is formed at a predetermined location in each of the circumferential wall portion of the first yoke and the supporting member for securing and supporting the magnetic circuit, the opening including an area where the joint member joining the voice coil unit and the coupling member moves in correspondence with movement of the voice coil unit.

2. The speaker apparatus of claim 1, wherein the joint member that joins the voice coil unit and the coupling member comprises a plurality of joint pieces that extend in directions transverse to the circumferential wall portion of the first yoke.

3. The speaker apparatus of claim 2, wherein a slit for each of the plurality of joint pieces to pass therethrough is formed as the opening in each of the circumferential wall portion of the first yoke and the supporting member.

4. The speaker apparatus of claim 1, wherein the voice coil unit and the coupling member face each other across the circumferential wall portion of the first yoke.

5. The speaker apparatus of claim 1, wherein the supporting member is formed by cutting and raising the bottom portion of the frame member.

6. The speaker apparatus of claim 1, wherein a hole is formed passing through the bottom portion of the frame member and the supporting member.

7. The speaker apparatus of claim 6, comprising a hole closing member for closing the hole from outside of the bottom portion of the frame member.

8. The speaker apparatus of claim 7, wherein the hole closing member comprises a closing plate portion and a fitting portion that fits into the hole, and an opening that coincides with the opening formed in the supporting member is formed in the fitting portion.

9. The speaker apparatus of claim 1, further comprising:

an inner edge component that is joined with the first yoke to resiliently support the diaphragm at a predetermined inner location thereof; and an outer edge component that is joined with an outer peripheral portion of the frame member to resiliently support the outer circumferential end portion of the diaphragm.

10. A speaker apparatus, comprising:

a frame member having a bottom portion;

a magnetic circuit including a recessed first yoke having a plate portion and a circumferential wall portion surrounding the plate portion, a magnet disposed inside the first yoke, and a second yoke disposed such that the second yoke and the plate portion of the first yoke sandwich the magnet and an annular magnetic gap is formed between the second yoke and the circumferential wall portion, wherein the bottom portion of the frame supports the magnetic circuit at an opposite circumferential end portion of the circumferential wall portion of the first yoke relative to the plate portion;

a voice coil unit disposed inside the magnetic gap in the magnetic circuit;

a coupling member disposed outward of the circumferential wall portion of the first yoke; and a diaphragm having its outer circumferential end portion coupled to the frame member and its inner circumferential end portion coupled to the coupling member, wherein the voice coil unit and the coupling member are joined by a joint member that extends in a direction transverse to the circumferential wall portion of the first yoke, and an opening is formed at a predetermined location in the circumferential wall portion of the first yoke magnetic circuit, the opening including an area where the joint member joining the voice coil unit and the coupling member moves in correspondence with movement of the voice coil unit.

11. The speaker apparatus of claim 10, wherein the joint member that joins the voice coil unit and the coupling member comprises a plurality of joint pieces that extend in directions transverse to the circumferential wall portion of the first yoke.

12. The speaker apparatus of claim 11, wherein a slit for each of the plurality of joint pieces to pass therethrough is formed as the opening in the circumferential wall portion of the first yoke.

13. The speaker apparatus of 10, wherein the voice coil unit and the coupling member face each other across the circumferential wall portion of the first yoke.

14. The speaker apparatus of claim 10, further comprising:

an inner edge component that is joined with the first yoke to resiliently support the diaphragm at a predetermined inner location thereof; and an outer edge component that is joined with an outer peripheral portion of the frame member to resiliently support the outer circumferential end portion of the diaphragm.

15. The speaker apparatus of claim 10, wherein the diaphragm extends horizontally from its outer circumferential end portion toward the inside of the diaphragm.

16. The speaker apparatus of claim 10, wherein a depth of the speaker apparatus between the diaphragm and the bottom portion of the frame member is less than about twice a height of the first yoke.

17. The speaker apparatus of claim 10, wherein a depth of the speaker apparatus between the diaphragm and the bottom portion of the frame member is approximately a height of the first yoke.

* * * * *